US005742981A

United States Patent [19]

Fehrer

[11] Patent Number: 5,742,981

[45] Date of Patent: Apr. 28, 1998

[54] DEVICE FOR DIVIDING A CARD WEB INTO LONGITUDINAL SECTIONS

[76] Inventor: Ernst Fehrer, Auf der Gugl 28, A-4020 Linz, Austria

[21] Appl. No.: 674,202

[22] Filed: Jul. 1, 1996

[30] Foreign Application Priority Data

Jul. 7, 1995 [AT] Austria ..... 1156/95

[51] Int. Cl.[6] ..... D01G 25/00

[52] U.S. Cl. ..... 19/151; 19/161.1

[58] Field of Search ..... 19/98, 106 R, 19/148, 150, 151, 296, 302, 303, 304, 307, 308, 161.1

[56] References Cited

U.S. PATENT DOCUMENTS

| | | | |
|---|---|---|---|
| 3,018,521 | 1/1962 | Harmon | 19/151 |
| 4,475,272 | 10/1984 | Wood | 19/151 |
| 4,583,267 | 4/1986 | Fehrer | 19/302 |
| 5,361,451 | 11/1994 | Fehrer | 19/296 |
| 5,517,726 | 5/1996 | Beier | 19/296 |

FOREIGN PATENT DOCUMENTS 331686 11/1975 Austria .

*Primary Examiner*—C. D. Crowder
*Assistant Examiner*—Larry D. Worrell, Jr.
*Attorney, Agent, or Firm*—Collard & Roe, P.C.

[57] ABSTRACT

A device for dividing a card web comprised of a loose structure of fibers into successive longitudinal sections, comprises an air-permeable conveyor belt having a conveyor strand carrying the card web on one side thereof for conveying the card web in a conveying direction, a suction box arranged on a side of the conveyor strand opposite the one side, the suction box defining a suction slot extending transversely to the conveyor strand and facing the opposite side of the conveyor strand, and a screen arranged to close the suction slot and to open it periodically whereby suction is applied to the card web through the air-permeable conveyor belt and a respective one of the longitudinal sections is separated from the card web by sucking the fibers in alignment with the suction slot out of the card web.

7 Claims, 2 Drawing Sheets

DEVICE FOR DIVIDING A CARD WEB INTO LONGITUDINAL SECTIONS

BACKGROUND OF THE INVENTION

1. Field of the Invention

This invention relates to a device for dividing a card web into longitudinal sections by means of an air-permeable conveyor belt.

2. Description of the Prior Art

Mechanically cutting into equally sized longitudinal sections a continuously produced card web, which has been placed on a draw-off conveyor, creates some difficulties, when during the cutting process the cutting tool used is not moved together with the card web in the conveying direction of the card web at the conveying speed of the web. Such movement of the cutting tool together with the continuously conveyed card web is rather complex, however, because prior to the actual use of the cutting tool the same must be accelerated by means of its drive unit to the conveying speed of the card web, and after the cutting operation must be decelerated and returned, before the above described operating cycle can be repeated. At higher conveying speeds, the length of the longitudinal sections to be separated from the card web can therefore not fall below a certain minimum.

SUMMARY OF THE INVENTION

It is therefore an object of the invention to provide a device for dividing a card web into longitudinal sections, without having to accept the disadvantages of a tool to be moved together with the card web.

Proceeding from a device of the above-described type, this object is solved by the invention in that on a side of the conveying strand of the conveyor belt facing away from the card web a suction box is provided, which has a suction slot extending transversely to the conveyor belt. The suction slot faces the conveying strand and can be closed by means of a screen.

The suction flow sucked through the air-permeable conveyor belt by the suction slot exerts a retaining force on the fibers of the card web moved on the conveyor belt, which force is sufficient to disrupt the comparatively loose fiber structure of a card web. When the suction slot is exposed by the opening in the screen, the part of the card web disposed in the suction area of the suction slot is held back from the web portion drawn away from the suction slot by the conveyor belt, so that the terminal fibers of the web portion moving on are pulled out of the retained web area, in particular when subsequent to the discharge side of the suction slot there is provided a pressure roller for urging the card web against the conveying strand of the conveyor belt. Between the pressure roller and the conveying strand of the conveyor belt there is formed a clamping gap for the card web, which provides for a sharp delimitation of the edge of the card web thus separated in transverse direction. The retained fibers form a thickened front edge of the next longitudinal section of the card web after the separation, but this thickening of the edge generally does not play a role in the further processing of the longitudinal sections, as these longitudinal sections are usually seamed.

When the suction slot is closed by means of the screen, the retaining force acting on the web fibers is eliminated, so that the card web can be moved on unimpededly by means of the conveyor belt. While the opening period of the suction slot determines the distance between the separated web portions in dependence on the conveying speed of the card web, the length of the longitudinal sections of the card web between two separations depends on the closing period. At high conveying speeds of the card web, short opening periods should therefore be provided. An easy way of ensuring such a short opening period is achieved by using as the screen a rotating body which surrounds the suction box and rotates in the longitudinal direction of the conveyor belt, and has at least one transverse slot. This rotating body can be driven at a corresponding rotating speed, so that the opening period is determined in dependence on the width of the transverse slot, which can be selected accordingly. The closing period is in this case determined by the period required for one rotation of the rotating body. The shell of a drum or an endless tape guided around deflection rollers can be used as rotating body.

Since the closing period for the suction slot depends on the rotation period of the rotating body, the rotation speed of the screen relative to the conveying speed of the conveyor belt can be varied between two separations for adjusting the length of the longitudinal sections of the card web. The direction in which the screen rotates does not play a role in this connection. If the conveying strand of the conveyor belt slides over the screen, it is, however, recommended that the screen should move in the same direction as the conveyor belt, so as to restrict the difference in speed.

If the separated longitudinal sections of the card web should have an inclined transverse edge, the suction slot of the suction box and/or the transverse slot of the screen form an acute angle with the longitudinal direction of the conveyor belt. In this case, the card web is not separated perpendicularly to the longitudinal edge, but at an angle thereto, since the disrupture of the fiber structure is effected along the edge of the suction slot on the discharge side. A similar effect can be achieved if the suction slot extends perpendicularly to the longitudinal edge and the transverse slot of the screen extends at an angle, because in this case the disrupture of the fiber structure proceeds from the one to the opposite side of the longitudinal edge and does not take place simultaneously over the enter width of the web, so that due to the conveying speed of the card web a correspondingly inclined line of separation is obtained.

BRIEF DESCRIPTION OF THE DRAWINGS

In the drawing the subject-matter of the invention is illustrated by way of example; In the drawing.

DETAILED DESCRIPTION OF THE PREFERRED EMBODIMENT

Figure 1:
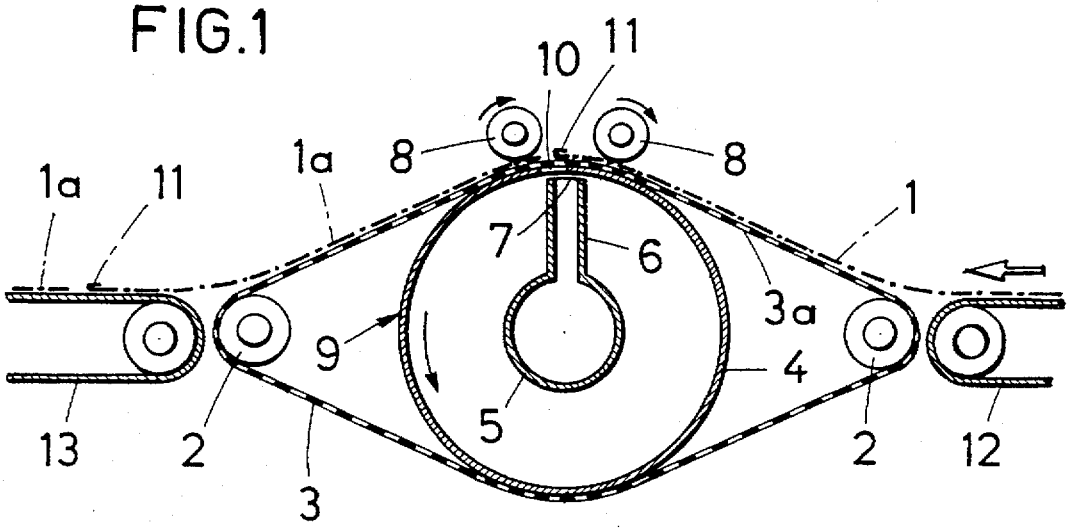
FIG. 1 is a schematic longitudinal sectional view of a device for dividing a card web into longitudinal sections according to the invention
Figure 2:
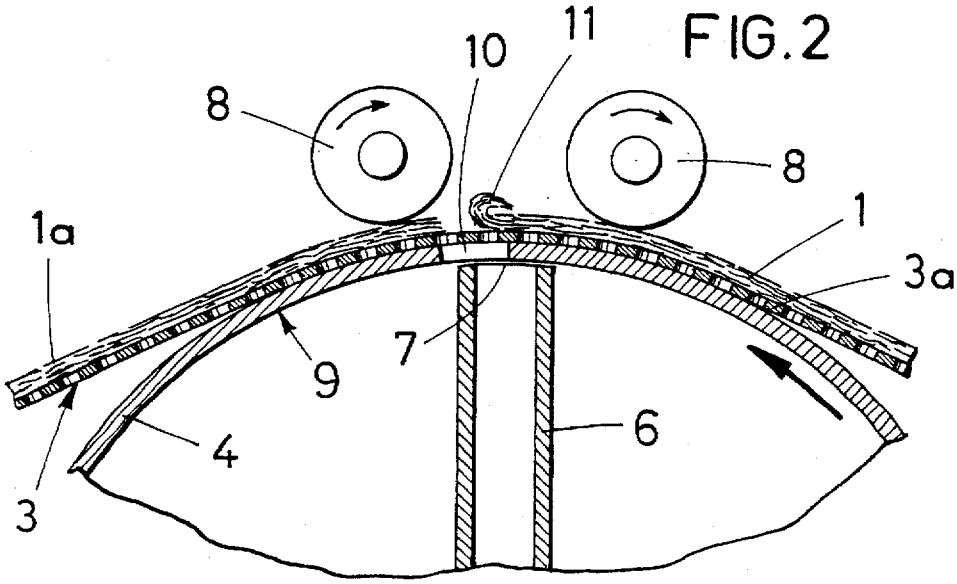
FIG. 2 is a fragmentary view of this device in the vicinity of the suction slot on an enlarged scale.
Figure 3:
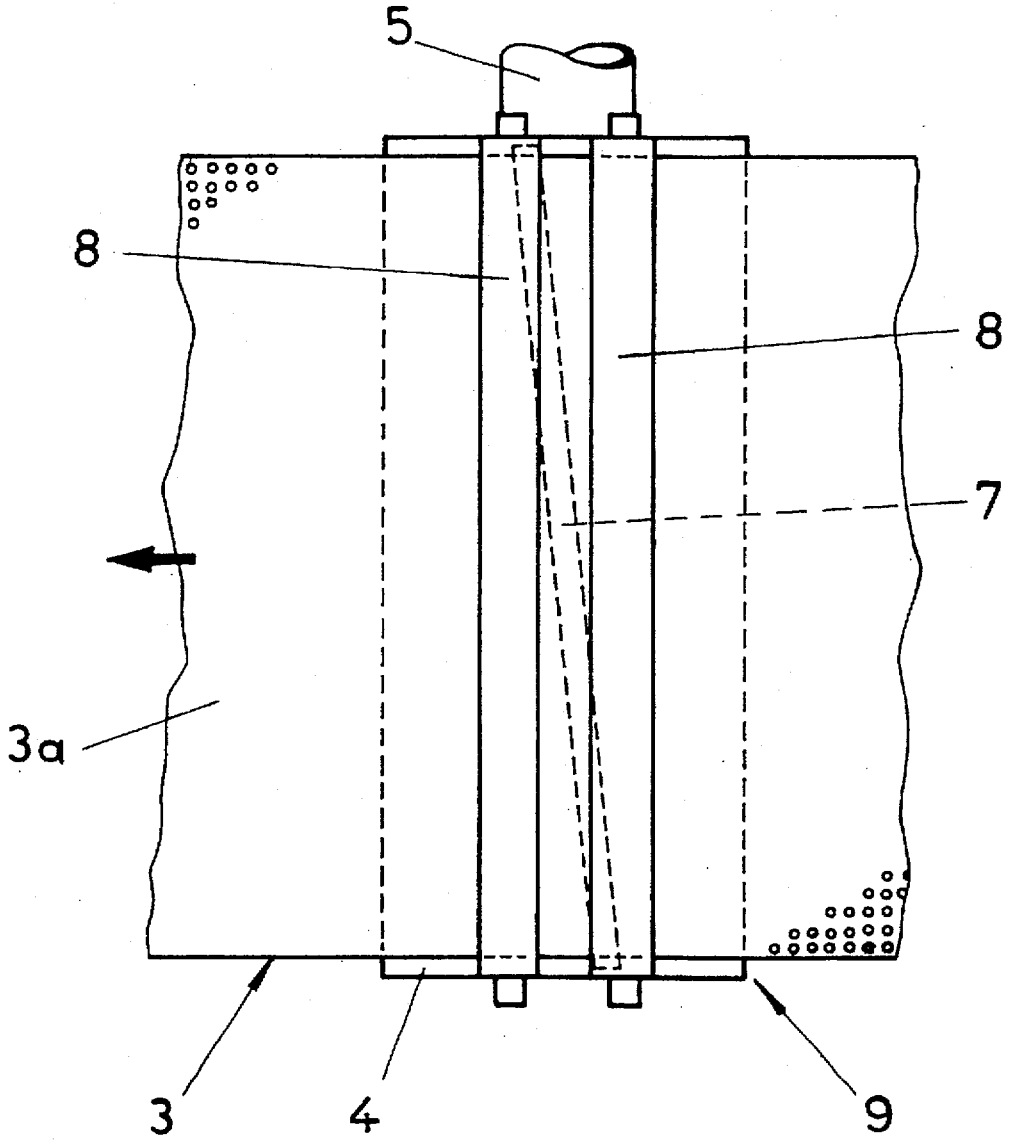
FIG. 3 is a top view of FIG. 2.

The device for dividing a card web 1 into longitudinal sections 1*a* in accordance with the illustrated embodiment comprises an air-permeable conveyor belt 3 which is guided around deflection rollers 2 and surrounds a rotating body 4 in the form of a drum, which can be driven about an axis of rotation extending parallel to the deflection rollers 2. Inside this rotating body 4, which may also be constituted by an air-permeable endless belt guided around deflection rollers, a suction box 5 is provided. The suction box has a suction port 6 defining a suction slot 7 extending transversely to the conveying strand 3*a* of the conveyor belt 3. Two pressure rollers 8 driven in the conveying direction of the conveyor belt 3 are mounted at respective sides of suction slot 7, and the pressure rollers and the conveying strand 3*a* of the conveyor belt 3 clamp the card web 1 and its longitudinal sections 1*a* therebetween to convey the card web.

The shell of the drum 4 surrounding the suction box 5 constitutes a screen 9 for the suction slot 7, which is interrupted by at least one transverse slot 10. The suction slot is therefore closed by the screen 9, as long as the transverse slot 10 does not register with the suction slot 7. When the suction slot 7 is closed, the card web 1 is conveyed unimpededly over the suction slot 7 by means of the conveyor belt 3. But when the transverse slot 10 of the screen 9 is aligned with the suction slot 7 during rotation of the drum, retaining forces act on the web fibers due to the suction acting on the card web 1, which retaining forces disrupt the comparatively loose fiber structure of a card web, all the more so as due to the conveying effect exerted by the pressure rollers 8, the terminal fibers of the longitudinal section 1*a* of the conveyor belt moving out of the region of the suction slot 7 are forcibly drawn out from the retained fiber structure between the roller 8 disposed behind the suction slot 7 in the conveying direction and the conveying strand 3*a* by forming a comparatively sharp separating edge. When the suction slot 7 is closed by the screen portion succeeding the transverse slot 10, the further conveyance of the section of the card web 1 succeeding the separated longitudinal section 1*a* is assured, until the transverse slot 10 again is aligned with the suction slot. Due to the retaining effect of the suction acting on the fibers of the card web, a thickened edge 11 is produced in the vicinity of the card web section succeeding the separated longitudinal section 1*a*. This thickened edge can then be cut off in the course of the further processing of the longitudinal sections 1*a*.

Since the suction slot 7 can be opened by means of the screen 9 only for comparatively short periods, card webs 1 having a high conveying speed can be divided into longitudinal sections 1*a* without having to interrupt the conveying process. The card web 1 can therefore be supplied directly from a carding machine by means of a feeding device 12 and can be passed on to a discharging device 13 at the web forming speed.

I claim:

1. A device for dividing a card web comprised of a loose structure of fibers into successive longitudinal sections, which comprises (a) an air-permeable conveyor belt having a conveyor strand carrying the card web on one side thereof for conveying the card web in a conveying direction, (2) a suction box arranged on a side of the conveyor strand opposite the one side, the suction box defining (1) a suction slot extending transversely to the conveyor strand and facing the opposite side of the conveyor strand, and (3) a screen arranged to close the suction slot and to open it periodically whereby suction is applied to the card web through the air-permeable conveyor belt and a respective one of the longitudinal sections is separated from the card web by sucking the fibers in alignment with the suction slot out of the card web.

2. The device of claim 1, wherein the suction slot encloses an acute angle with the longitudinal extension of the conveyor belt.

3. The device of claim 1, further comprising a pressure roller adjacent a leading edge of the suction slot in the conveying direction, the pressure roller being arranged to urge the respective longitudinal section separated from the card web against the conveyor strand of the air-permeable conveyor belt.

4. The device of claim 3, further comprising a pressure roller adjacent a trailing edge of the suction slot in the conveying direction, the pressure roller being arranged to urge the card web separated from the respective longitudinal section against the conveyor strand of the air-permeable conveyor belt.

5. The device of claim 1, wherein the screen is a rotating body surrounding the suction box and rotating in the conveying direction, the rotating body having at least one transversely extending slot periodically movable into alignment with the suction slot upon rotation of the rotating body for opening the suction slot.

6. The device of claim 5, wherein the rotating body has a rotary speed adjustable relative to the conveying speed of the air-permeable conveyor belt.

7. The device of claim 5, wherein the transversely extending slot encloses an acute angle with the longitudinal extension of the conveyor belt.

* * * * *